US008474196B2

(12) United States Patent
Marriott

(10) Patent No.: US 8,474,196 B2
(45) Date of Patent: Jul. 2, 2013

(54) MODULAR DECKING SYSTEM

(76) Inventor: Cameron Marriott, Calgary (CA)

( * ) Notice: Subject to any disclaimer, the term of this patent is extended or adjusted under 35 U.S.C. 154(b) by 94 days.

(21) Appl. No.: 13/269,687

(22) Filed: Oct. 10, 2011

(65) Prior Publication Data

US 2013/0086864 A1 Apr. 11, 2013

(51) Int. Cl.
*E04F 15/00* (2006.01)

(52) U.S. Cl.
USPC ..... 52/177; 52/592.1; 52/480

(58) Field of Classification Search
USPC ..... 52/177, 588.1, 480, 592.1, 489.1, 52/263, 181, 579, 483.1
See application file for complete search history.

(56) References Cited

U.S. PATENT DOCUMENTS 3,043,407 A * 7/1962 Marryatt ..... 52/588.1
3,046,852 A * 7/1962 Graham ..... 52/581
3,110,371 A * 11/1963 De Ridder ..... 52/588.1
3,301,147 A * 1/1967 Clayton et al. ..... 404/35
3,385,182 A * 5/1968 Harvey ..... 404/35
3,385,183 A * 5/1968 Kortz ..... 404/35
3,528,391 A 9/1970 Johnson
3,680,530 A * 8/1972 Drawsky ..... 119/529
3,999,346 A 12/1976 Fetherston
4,266,381 A * 5/1981 Deller ..... 52/177
4,566,243 A * 1/1986 Dahlin ..... 52/578
4,907,387 A * 3/1990 Turnbull ..... 52/177
4,947,595 A * 8/1990 Douds et al. ..... 52/177
5,009,045 A * 4/1991 Yoder ..... 52/177
5,048,448 A * 9/1991 Yoder ..... 114/263
5,050,361 A 9/1991 Hallsten
5,050,362 A * 9/1991 Tal et al. ..... 52/588.1
5,170,605 A * 12/1992 Huddle ..... 52/588.1
5,185,193 A * 2/1993 Phenicie et al. ..... 428/57
5,204,149 A * 4/1993 Phenicie et al. ..... 428/57
5,351,458 A * 10/1994 Lehe ..... 52/586.2
5,553,427 A * 9/1996 Andres ..... 52/177
5,613,339 A * 3/1997 Pollock ..... 52/836
5,642,592 A * 7/1997 Andres ..... 52/177
5,647,184 A 7/1997 Davis
5,735,097 A 4/1998 Cheyne
5,758,456 A * 6/1998 Case ..... 52/177
5,758,467 A 6/1998 Snear et al.
5,811,035 A * 9/1998 Mockry ..... 261/111
5,816,010 A 10/1998 Conn
5,819,491 A * 10/1998 Davis ..... 52/592.1
5,826,382 A * 10/1998 Elsasser et al. ..... 52/181
5,881,508 A * 3/1999 Irvine et al. ..... 52/177
5,913,784 A * 6/1999 Hite ..... 52/177
5,950,377 A * 9/1999 Yoder ..... 52/177

(Continued)

*Primary Examiner* — William Gilbert
*Assistant Examiner* — James Ference
(74) *Attorney, Agent, or Firm* — Maxey Law Offices; Stephen Lewellyn

(57) ABSTRACT

A modular decking system includes a plurality of elongated deck members for placement across a subsurface. Each plurality of elongated deck members has a top deck portion, opposed first and second downwardly extending sides having outwardly and laterally extending longitudinal flanges, and a plurality of laterally spaced and longitudinally extending leg members extending downwardly from the top deck portion between the first and second sides. An elongated connector, connecting adjacent first and second deck members of the plurality of deck members, has a horizontal base portion having first and second laterally spaced and upwardly extending sidewalls and an interconnecting wall extending between the first and second sidewalls forming an upwardly opening channel adapted to receive the first and second longitudinal flanges of the first and second deck members, respectively, and forming a longitudinal gutter disposed between the top deck portions of the first and the second deck members.

19 Claims, 4 Drawing Sheets

U.S. PATENT DOCUMENTS

| | | | | |
|---|---|---|---|---|
| 6,018,925 | A * | 2/2000 | Biro | 52/177 |
| 6,044,598 | A * | 4/2000 | Elsasser et al. | 52/181 |
| 6,199,340 | B1 * | 3/2001 | Davis | 52/592.1 |
| 6,226,950 | B1 | 5/2001 | Davis | |
| 6,233,886 | B1 | 5/2001 | Andres | |
| 6,324,796 | B1 | 12/2001 | Heath | |
| 6,594,961 | B2 * | 7/2003 | Leines | 52/177 |
| 6,619,002 | B2 * | 9/2003 | Pettit | 52/177 |
| 6,637,163 | B2 * | 10/2003 | Thibault et al. | 52/177 |
| 6,694,681 | B1 * | 2/2004 | Andres | 52/177 |
| 6,739,106 | B2 * | 5/2004 | Curatolo | 52/592.1 |
| 6,918,221 | B2 * | 7/2005 | Williams | 52/592.1 |
| 6,986,934 | B2 * | 1/2006 | Chen et al. | 428/195.1 |
| 7,021,012 | B2 * | 4/2006 | Zeng et al. | 52/177 |
| 7,047,697 | B1 * | 5/2006 | Heath | 52/177 |
| 7,415,801 | B2 | 8/2008 | Zeng et al. | |
| 7,520,092 | B2 * | 4/2009 | Showers et al. | 52/177 |
| RE41,140 | E * | 2/2010 | Heath | 52/177 |
| 7,673,425 | B2 * | 3/2010 | Thomas | 52/177 |
| 7,763,345 | B2 * | 7/2010 | Chen et al. | 428/195.1 |
| 7,793,469 | B2 * | 9/2010 | Murphy et al. | 52/177 |
| 7,900,416 | B1 * | 3/2011 | Yokubison et al. | 52/592.1 |
| 2005/0039413 | A1 | 2/2005 | Schrotenboer | |
| 2005/0204661 | A1 * | 9/2005 | Showers et al. | 52/263 |
| 2005/0204662 | A1 * | 9/2005 | Showers et al. | 52/263 |
| 2005/0210774 | A1 * | 9/2005 | Zeng et al. | 52/177 |
| 2006/0288651 | A1 * | 12/2006 | Zeng et al. | 52/177 |
| 2007/0044416 | A1 * | 3/2007 | Van Dijk | 52/650.3 |
| 2007/0251166 | A1 * | 11/2007 | Thiagarajan et al. | 52/177 |

* cited by examiner

MODULAR DECKING SYSTEM

FIELD OF THE INVENTION

The present invention relates generally to the construction of decking, flooring and roofing, and more particularly, relating to a modular decking system including interconnectable deck members that once connected form one or more gutters to allow water to drain off the decking and thus off the subsurface upon which the decking is installed.

BACKGROUND OF THE INVENTION

Modular construction systems for decking, flooring and roofing coverings have become a popular alternative to traditional covering constructions due to their easy in transporting, handling and installation, their resistance to adverse weather conditions, and because their cost to benefit ratio exceeds that of traditional constructions.

While existing modular systems meet their respective objectives and requirements, drawbacks exist. In certain decking systems, the deck members are extruded from a plastic material requiring the decking system to include complex clips and/or connectors to secure the members to avoid cracking of the members as a result of driving fasteners through the members during installation. Plastic decking systems have been developed that include deck members having internal reinforcing webs to increase the strength of the deck member to permit the driving of fasteners through the deck member without cracking. However, the deck members of these systems have a complex extrusion geometry which increases the cost of manufacture. Further, while the improvement eliminates the need for complex clip systems, plastic is still prone to cracking and failure from impact by other objects.

Another system attempts to eliminate an existing drawback in current modular systems in the handling of water runoff by providing a deck member that when secured to an adjacent deck member the two members form a gutter for receiving and directing water runoff. However, the gutter of this system is not water tight and further requires the penetration of fasteners through the gutter and into the underlying subsurface for installation, which compromises the underlying subsurface from exposure to water.

Another drawback to existing decking systems is found in the instance where the subfloor or supporting structure needs to be accessed for repair or for other purposes, such as installing utilities lines (electrical, water, gas, etc) between the subfloor and decking supported upon the subfloor. In these circumstances, prior decking systems require the removal of a majority of the decking to permit access for the desired purpose. This is particularly problem some with tongue and groove type decking systems.

Accordingly, there is a need for new modular decking, flooring and roof covering system that overcomes all of the above discussed drawbacks and other drawbacks in existing systems.

SUMMARY OF THE INVENTION

The embodiments of the present invention addresses these needs by providing a modular decking system including a simplified deck member and connecting member that may be used in the construction of decking, flooring, roof coverings docks, gang ways, walk ways and the like.

Embodiments of the invention also provide a modular decking system including a deck member and connector member that forms a watertight gutter between adjacent deck members for receiving and directing water runoff from the decking and underlying subsurface.

Embodiments of the invention also provide a modular decking system that is lightweight and easy to install.

Embodiments of the invention also provide a modular decking system having a construction that permits the removal and replacement of a single deck member without requiring the removal all or a majority of the assembled deck members.

Embodiments of the invention also provide a modular decking system having a construction that permits selective, temporary removal and re-installation of decking panels for the purpose of accessing the underlying support surface or a space between the decking and the underlying support surface.

Embodiments of the invention also provide a modular decking system that may be installed over a subsurface that comprises a joist system or a complete surface, and which may also be installed over existing decking, flooring and/or coverings.

Embodiments of the invention also provide a modular decking system having a deck member that maybe easily assembled other with a plurality of like deck members to form a decking, flooring or roof covering.

To achieve these and other advantages, in general, in one aspect a decking system is provided and includes a plurality of elongated deck members for placement in a lateral side-by-side relation with each other across a subsurface. Each of the plurality of elongated deck members having a top deck portion, opposed first and second downwardly extending sides and a plurality of laterally spaced and longitudinally extending leg members extending downwardly from the top deck portion between the first and second sides. The first side has formed thereon a first outwardly and laterally extending longitudinal flange and the second side has formed thereon a second outwardly and laterally extending longitudinal flange. An elongated connector connects adjacent first and second deck members of the plurality of deck members and has a horizontal base portion having formed thereon first and second laterally spaced and upwardly extending sidewalls, and an interconnecting wall extending between the first and second sidewalls forming an upwardly opening channel adapted to receive therein in an overlapping relation the first longitudinal flange of the first deck member and the second longitudinal flange of the second deck member forming a longitudinal gutter disposed between the top deck portions of the first and the second deck members.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
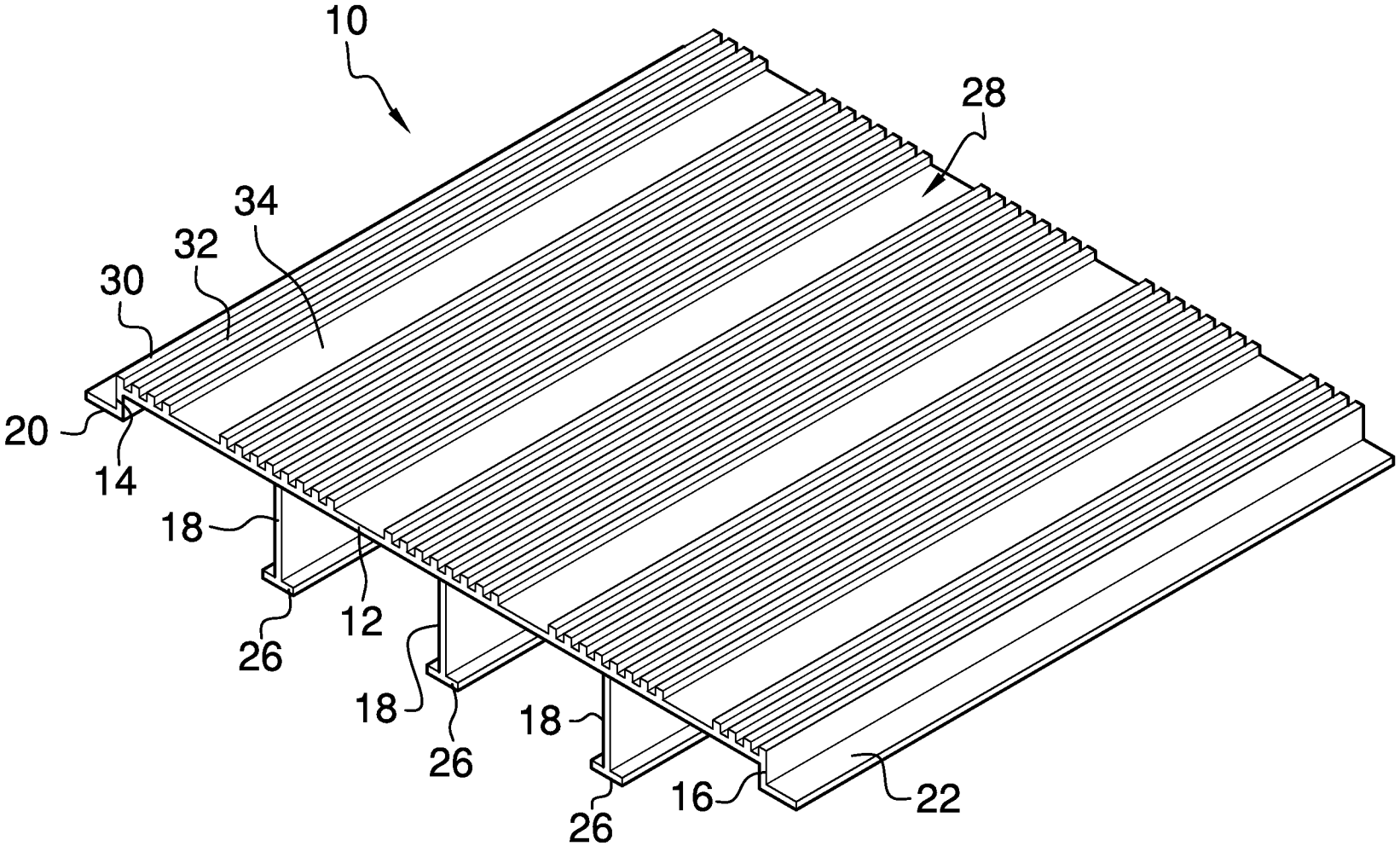
FIG. 1 is a perspective view of a deck member in accordance with an embodiment of the invention.
Figure 2:
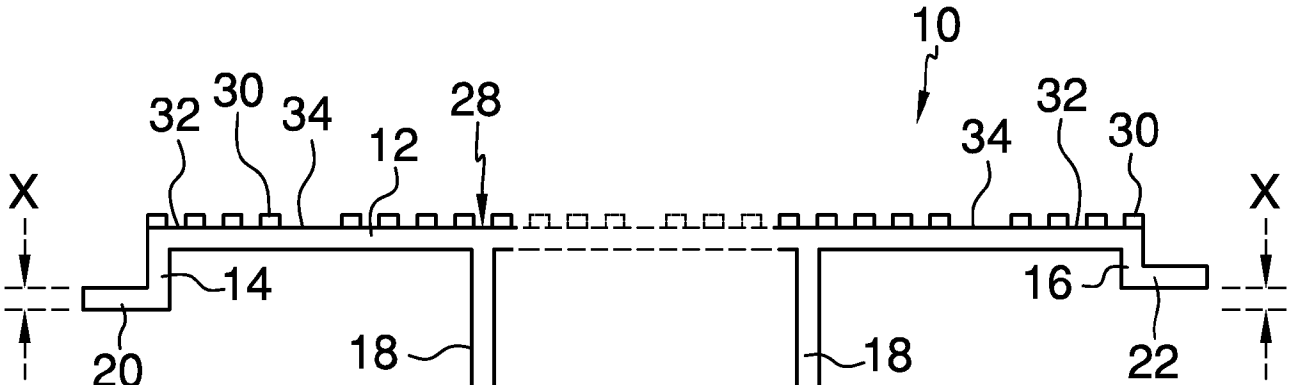
FIG. 2 is an end view of a deck member in accordance with an embodiment of the invention.

Referring to FIGS. 1 and 2 of the drawings there is illustrated an elongated deck member 10 having a horizontal top deck portion 12, a first sidewall 14 extending downwardly from the top deck portion, a second sidewall 16 extending downwardly from the top deck portion along an opposite side from the first sidewall, and of plurality of laterally spaced and longitudinally extending leg members 18 extending downwardly from the top deck portion between the first and second sides. One or more the leg members 18 includes a foot portion 26 formed at the terminal lower end thereof for engagement with a subsurface to more evenly distribute load across the subsurface.

The first sidewall 14 terminates at first longitudinal flange 20 that extends laterally and outwardly from the first sidewall in a direction opposite of the second sidewall. Similarly, the second sidewall 16 terminates at a second longitudinal flange 22 that extends latterly and outwardly from the second sidewall in a direction opposite of the first sidewall. The first sidewall 14 terminates at a greater length than the length of the second sidewall 16, as best seen in FIG. 2, to permit the flanges 20 and 22 adjacent deck members to be overlapped, as will be explained in further detail below. Preferably, the second sidewall 16 is shorter than the first sidewall 14 a distance X equal to the wall thickness of flange 18.

In an embodiment, the exterior surface 28 of the top deck portion 12 may be textured for functional and aesthetic purposes. For example, the exterior surface 28 may include a series of ridges 30 separated by narrow valleys 32. Each section of ridges 30 and valleys 32 may be separated by a wide valley 34.

Deck member 10 is preferable extruded from aluminum or some other suitable metal or metal alloy. However, deck member 10 could be extruded from other materials, including plastics.

Figure 3:
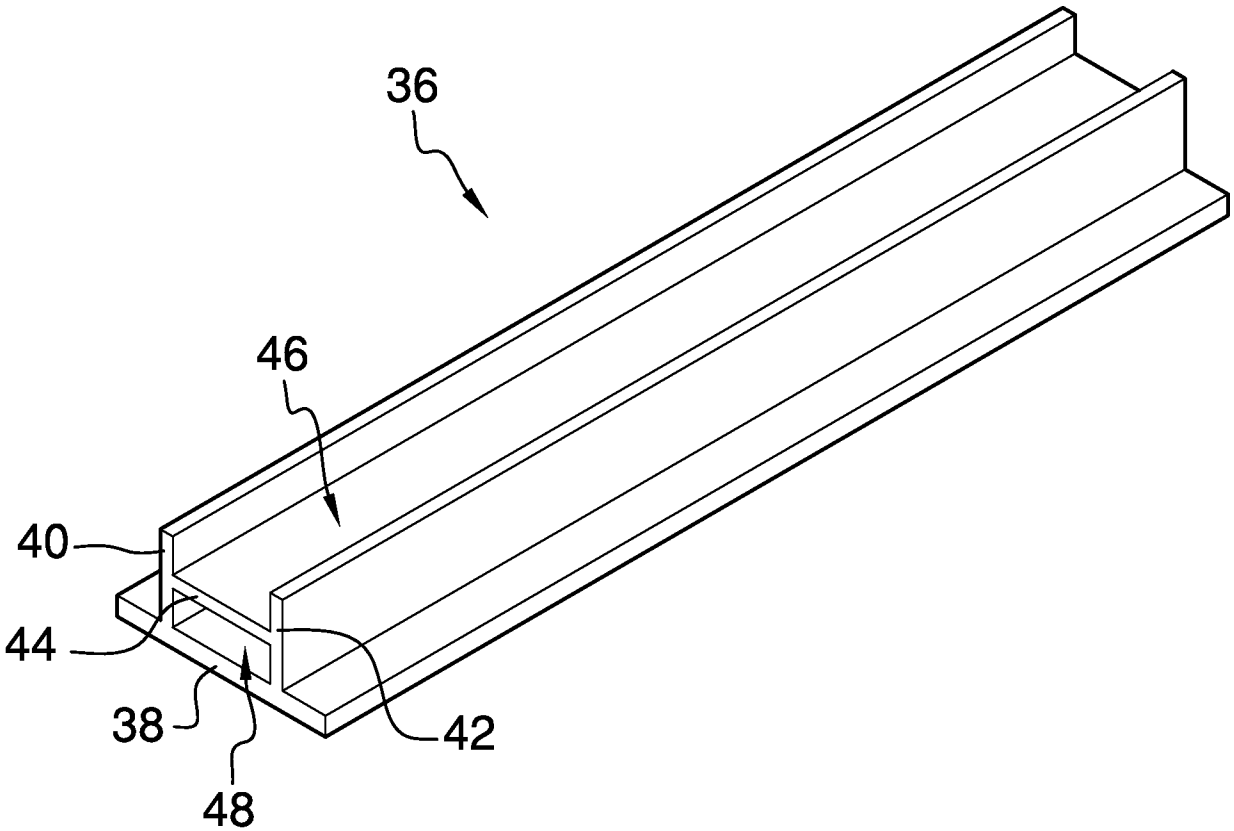
FIG. 3 is a perspective view of a connector member in accordance with an embodiment of the invention for connecting two deck members together.

Referring now to FIG. 3, there is illustrated an elongated connector member 36 for securing adjacent deck members 10 together. Connector member 36 includes a horizontal base portion 38 having formed thereon a first and second laterally spaced and upwardly extending sidewalls 40 and 42, and an interconnecting wall 44 extending between and joining together sidewalls 40 and 42 forming an upwardly opening and longitudinally extending channel 46. Base portion 38 together with sidewalls 40 and 42 and interconnecting wall 44 forms an enclosed, longitudinal conduit 48 disposed vertically below channel 46. Connector member 36 is preferable extruded from aluminum or some other suitable metal or metal alloy. However, connector member 36 could be extruded from other materials, including plastics.

Figure 4:
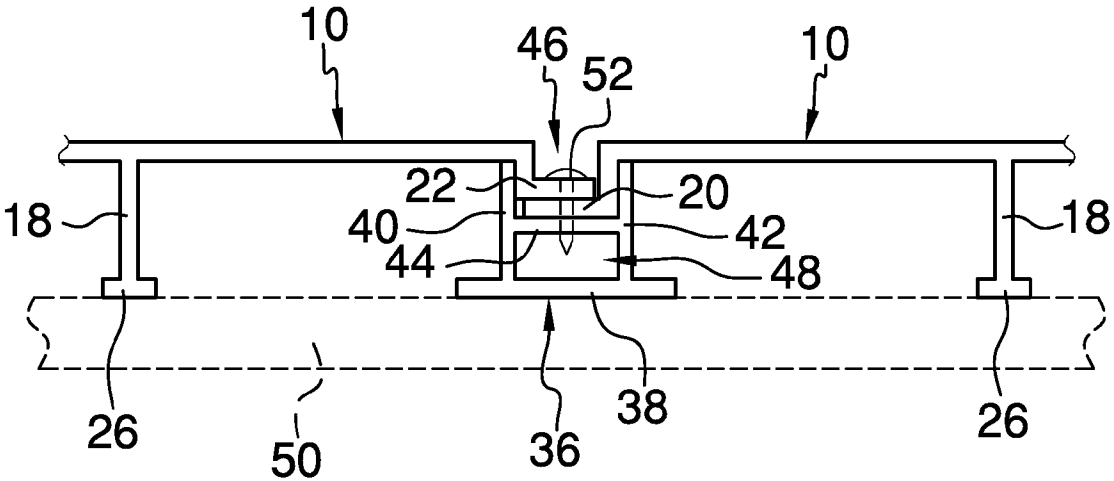
FIG. 4 is an end view of two deck members connected together by a connector member and disposed across a subsurface in accordance with an embodiment of the invention.

Referring now to FIG. 4, there is illustrated two adjacent deck members 10 arranged side-by-side across a subsurface 50. Subsurface may be a deck surface, a structure comprising spaced joists, a roof surface, a floor surface or another suitable surface. Deck members 10 are connected together by connector member 36 with flanges 20 and 22 of the adjacent deck members disposed in an overlap relation within channel 46 of the connector member. The flanges 20 and 22 and the connector member 36 are secured by a penetrating fastener 52 disposed within the channel 46 extending only through the flanges 20 and 22 and the interconnecting wall 44 of the connector member. To this end, flanges 20 and 22 and channel 46 forms a longitudinal gutter between the top deck portions 12 of each deck member 10 for receiving runoff water from the top deck portions and direction the runoff water to the edge of the subsurface. Likewise, conduit 48 will receive any runoff water that may migrate across the flanges 20 and 22 and the interconnecting wall from as a result of the fastener 52 penetrating therethrough and direct the runoff water to the edge of the subsurface 50.

Figure 5:
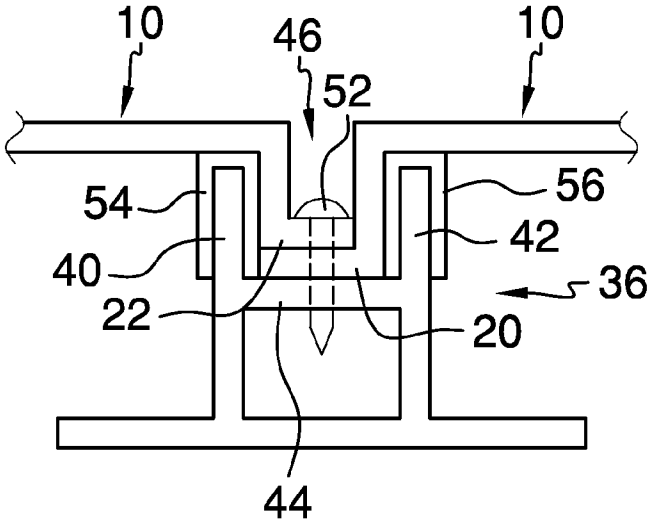
FIG. 5 is a partial end view of two deck members connected together by a connector member and including seals disposed between the deck members and the connector member.

Turning to FIG. 5, elongated seals 54, 56 (shown exaggerated in size for purpose of illustrative clarity) may be disposed along sidewalls 40 and 42, respectively, and provide a sealing contact between sidewall 40 and flange 22 and sidewall 42 and flange 20. Seals 54, 56 prevent water from migrating over sidewalls 40 and 42 between the contact surfaces of sidewall 40 and flange 22 and sidewall 42 and flange 20. Stated otherwise, seals 54, 56 prevent water from escaping from channel 46 between deck members 10, that otherwise may cause water damage to an underlying support surface upon which deck members are supported. As illustrated here, seals 54, 56 are depicted as generally being U-shaped and positioned over sidewalls 40 and 42 with the sidewalls being received by the respective seal. However, other seal configurations are possible.

Figure 6:
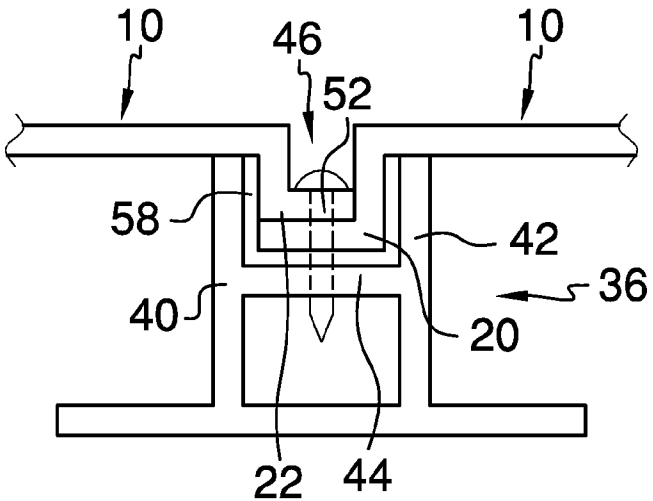
FIG. 6 is a partial end view of two deck members connected together by a connector member and including an alternative seal.

With reference to FIG. 6, one possible alternative seal configuration is illustrated, wherein a single elongated U-shaped seal 58 is disposed within channel 46 with the seal extending sidewalls 40 and 42, and interconnecting wall 44 and between flanges 20 and 22, thereby providing a sealing contact therebetween. Of course, other seal configurations are possible.

A number of embodiments of the present invention have been described. Nevertheless, it will be understood that various modifications may be made without departing from the spirit and scope of the invention. Accordingly, other embodiments are within the scope of the following claims.

What is claimed is:

1. A decking system, comprising:

a plurality of elongated deck members, each one of said plurality of elongated deck members for placement in a lateral side-by-side relation with another one of said plurality of elongated deck members across a subsurface;

each of said plurality of elongated deck members having a top deck portion, opposed first and second downwardly extending sides and a plurality of laterally spaced and longitudinally extending leg members extending downwardly from said top deck portion between said first and second sides, wherein said first side has formed thereon a first outwardly and laterally extending longitudinal flange and wherein said second side has formed thereon a second outwardly and laterally extending longitudinal flange; and an elongated connector for connecting adjacent first and second deck members of said plurality of deck members, said connector having a horizontal base portion parallel to said subsurface, said horizontal base portion having formed thereon first and second laterally spaced and upwardly extending sidewalls, and an interconnecting wall extending between said first and second sidewalls forming an upwardly opening channel adapted to receive therein in an overlapping relation said first longitudinal flange of said first deck member and said second longitudinal flange of said second deck member forming a longitudinal gutter disposed between said top deck portions of said first and said second deck members.

2. The decking system of claim 1, wherein said horizontal base portion, said first and second sidewalls and said interconnecting wall of said connector member together define a longitudinal conduit.

3. The decking system of claim 1, further comprising:

a surface tread formed on an exterior surface of said top deck portion.

4. The decking system of claim 1, wherein each of said plurality of deck members is formed of a continuous extrusion, and wherein said connector is formed of a continuous extrusion.

5. The decking system of claim 4, wherein each of said plurality of deck members and said connector is aluminum.

6. The decking system of claim 1, wherein said first side of said top deck portion terminates at said first flange, and wherein said second side of said top deck portion terminates at said second flange.

7. The decking system of claim 1, wherein each of said leg members has a foot portion.

8. A decking system, comprising:

a plurality of elongated deck members, each one of said plurality of elongated deck members placed laterally in side-by-side relation with another one of said plurality of elongated deck members across a subsurface;

each of said plurality of elongated deck members having a top deck portion having opposed first and second downwardly extending sides and a plurality of laterally spaced and longitudinally extending leg members extending downwardly from said top deck portion between said first and second sides, wherein said first side has formed thereon a first outwardly and laterally extending longitudinal flange and wherein said second side has formed thereon a second outwardly and laterally extending longitudinal flange; and an elongated connector connecting adjacent first and second deck members of said plurality of deck members, said connector having a horizontal base portion parallel to said subsurface, said horizontal base portion having formed thereon first and second laterally spaced and upwardly extending sidewalls, and an interconnecting wall extending between said first and second sidewalls forming an upwardly opening channel having received therein in an overlapping relation said first longitudinal flange of said first deck member and said second longitudinal flange of said second deck member forming a longitudinal gutter disposed between said top deck portions of said first and said second deck members, and wherein one or more fasteners are disposed within said gutter and secure said first and said second deck members and said connector together by extending only through said overlapped first longitudinal flange and said second longitudinal flange, and said interconnecting wall.

9. The decking system of claim 8, wherein said horizontal base portion, said first and second sidewalls and said interconnecting wall of said connector member together define a longitudinal conduit.

10. The decking system of claim 8, further comprising:

a surface tread formed on an exterior surface of said top deck portion.

11. The decking system of claim 8, wherein each of said plurality of deck members is formed of a continuous extrusion, and wherein said connector is formed of a continuous extrusion.

12. The decking system of claim 11, wherein each of said plurality of deck members and said connector is aluminum.

13. The decking system of claim 8, wherein said first side of said top deck portion terminates at said first flange, and wherein said second side of said top deck portion terminates at said second flange.

14. The decking system of claim 8, wherein each of said leg members has a foot portion.

15. A decking system, comprising:

a plurality of elongated first extrusions, each one of said plurality of elongated first extrusions for placement in a lateral side-by-side relation with another one of said plurality of elongated first extrusions across a subsurface;

each of said plurality of elongated first extrusions having a top deck portion having opposed first and second downwardly extending sides and a plurality of laterally spaced and longitudinally extending leg members extending downwardly from said top deck portion between said first and second sides, wherein said first side has formed thereon a first outwardly and laterally extending longitudinal flange and wherein said second side has formed thereon a second outwardly and laterally extending longitudinal flange; and an elongated connector extrusion for connecting adjacent first and second extrusions of said plurality of elongated first extrusions, said connector extrusion having a horizontal base portion parallel to said subsurface, said horizontal base portion having formed thereon first and second laterally spaced and upwardly extending sidewalls, and an interconnecting wall extending between said first and second sidewalls forming an upwardly opening channel adapted to receive therein in an overlapping relation said first longitudinal flange of said first extrusion and said second longitudinal flange of said second extrusion forming a longitudinal gutter disposed between said top deck portions of said first and said second extrusions.

16. The decking system of claim 15, wherein said horizontal base portion, said first and second sidewalls and said interconnecting wall of said connector extrusion together define a longitudinal conduit.

17. The decking system of claim 15, further comprising:

a surface tread formed on an exterior surface of said top deck portion.

18. The decking system of claim 15, wherein said first side of said top deck portion terminates at said first flange, and wherein said second side of said top deck portion terminates at said second flange.

19. The decking system of claim 15, wherein each of said leg members has a foot portion.

* * * * *